US006994148B1

(12) United States Patent
McKibben et al.

(10) Patent No.: US 6,994,148 B1
(45) Date of Patent: Feb. 7, 2006

(54) METHOD AND APPARATUS FOR VENTING A GAS IN A LINED PRESSURE FURNACE

(75) Inventors: Kenneth D. McKibben, Defiance, OH (US); Daniel D. Minor, Cadillac, MI (US); Alan P. Gould, Tawas City, MI (US); Robert L. Macheske, Tawas City, MI (US); Dean VanderJagt, Essexville, MI (US); Rick Van Horn, Hale, MI (US); Khushal Wardak, Whitehall, MI (US); Roger Mucci, Saugatuck, MI (US); John Starks, Muskegon, MI (US)

(73) Assignee: Hayes Lemmerz International, Inc., Northville, MI (US)

( * ) Notice: Subject to any disclaimer, the term of this patent is extended or adjusted under 35 U.S.C. 154(b) by 49 days.

(21) Appl. No.: 10/749,113

(22) Filed: Dec. 30, 2003

(51) Int. Cl.
*B22D 17/06* (2006.01)
*B22D 41/00* (2006.01)
*B22D 41/02* (2006.01)

(52) U.S. Cl. ..... 164/335; 164/306

(58) Field of Classification Search ..... 164/119, 164/133, 306, 335
See application file for complete search history.

(56) References Cited

U.S. PATENT DOCUMENTS

| | | | | |
|---|---|---|---|---|
| 3,628,598 A | * | 12/1971 | MacNeill et al. | 164/350 |
| RE32,192 E | | 6/1986 | Vayssiere et al. | |
| 4,705,563 A | | 11/1987 | Poeppel et al. | |
| 4,989,841 A | | 2/1991 | Tokumasu et al. | |
| 5,205,346 A | | 4/1993 | Kuhn et al. | |
| 5,282,608 A | | 2/1994 | Duca et al. | |
| 5,443,654 A | | 8/1995 | Hiltunen et al. | |
| 5,718,416 A | | 2/1998 | Flisakowski et al. | |
| 5,735,935 A | | 4/1998 | Areaux | |
| 5,887,647 A | | 3/1999 | Melville et al. | |
| 5,948,352 A | | 9/1999 | Vender Jagt et al. | |
| 6,068,812 A | | 5/2000 | Areaux et al. | |
| 6,113,670 A | | 9/2000 | Nealon et al. | |
| 6,443,216 B1 | | 9/2002 | Lombard et al. | |
| 6,581,673 B1 | | 6/2003 | McKibben et al. | |
| 6,585,797 B2 | | 7/2003 | Kinosz et al. | |
| 6,607,578 B2 | | 8/2003 | Otaki et al. | |
| 6,609,557 B1 | | 8/2003 | Anderson | |
| 6,627,146 B1 | | 9/2003 | McKibben et al. | |

FOREIGN PATENT DOCUMENTS

WO 02/058863 8/2002

* cited by examiner

*Primary Examiner*—Kuang Y. Lin
(74) *Attorney, Agent, or Firm*—MacMillan, Sobanski & Todd, LLC

(57) ABSTRACT

A casting machine furnace apparatus that includes a furnace adapted to receive molten metal is described herein. The furnace includes an outer wall structure, a cover adapted to seal the furnace, a source of fluid, and a casting apparatus in fluid communication with the molten metal. The fluid is supplied into the furnace for applying fluid pressure on the molten metal. The application of fluid pressure on the molten metal causes the molten metal to supply the casting apparatus. The outer wall structure of the furnace is provided with a plurality of exhaust ports where the ports are provided in the outer wall structure at predetermined locations. The ports are selectively controllable between a first closed position, where the exhaust ports do not allow air to be exhausted from the furnace, and a second opened position, where the exhaust ports enable air to be exhausted from the furnace.

22 Claims, 5 Drawing Sheets

METHOD AND APPARATUS FOR VENTING A GAS IN A LINED PRESSURE FURNACE

BACKGROUND OF THE INVENTION

This invention relates in general to a casting machine and in particular to an improved method and apparatus of venting a fluid from a lined pressure furnace of such a casting machine.

Pressure pouring of molten metal from a furnace to fill a mold cavity has been used for several decades despite a number of problems. At room temperature, the metal is solid and becomes fluid when melted with sufficient heat. It is known to use a low pressure countergravity casting apparatus to cast molten metal into a mold. One example of such an apparatus is described in U.S. Pat. No. 5,215,141. Basically, in a low pressure countergravity casting apparatus, molten metal is supplied to a machine furnace under pressure. The molten metal is first received into a furnace of the machine furnace. The molten metal in the furnace is then transported to a mold though a feed tube. The machine furnace includes a supply conduit for introducing a gas under pressure into the machine furnace. As the gas is introduced into the machine furnace, the molten metal in the machine furnace is forced through a submerged feed tube, or evacuation conduit, into the mold. The evacuation conduit is commonly referred to as a stalk tube. The mold receives the molten metal through holes in the bottom of the mold. The molten metal in the mold cooling and hardening produces a cast article. A controller is used to adjust the pressure at which the gas is being introduced into the machine furnace. Thus, it can be seen that the machine furnace, the casting apparatus, and the mold are in fluid communication.

One potential problem during a casting operation is that the lined pressure furnace can suffer from excess gases flowing up though a bath of molten metal when the furnace is depressurized. In normal pressure casting operations, gases are introduced into the porous lining of the furnace during the pressurization cycle, which often lasts more than sixty seconds. Upon rapid depressurization, gases that have infiltrated the porous lining of the furnace seek the easiest way or path of least resistance out of the lining. Much of the trapped gas finds its way out of the porous lining below the surface of the melt and can contaminate the melt with oxygen as the gas rises to the surface (as shown by the phantom arrows X3 in FIG. 3). As the gas rises in the melt, the gas tends to effervesce or bubble thereby creating a greater interaction with, and thus contamination of, the melt. The porous lining as well as the riser tubes can also become contaminated with oxide formation. The rising gases can also stir sediment from the bottom of the furnace thereby adding contamination to the melt. When immersion heaters are used in this type of furnace, the gas bubbles that come into contact with the surface of the heaters form insulating oxides on the surface of the heaters, thereby reducing their effectiveness. Bubbles that are small rise slowly and some are in suspension near the riser tubes long enough to be forced into the next casting when the next cycle begins, thereby degrading the quality of the castings. Thus, it would be desirable to provide an improved method and apparatus for a pressure lined furnace of a casting machine which is operative to reduce the contamination of the melt by providing an easier path for the gases to escape from the lining of the furnace.

SUMMARY OF THE INVENTION

This invention relates to a casting machine furnace apparatus that includes a furnace adapted to receive molten metal. The furnace includes an outer wall structure, a cover adapted to seal the furnace, a source of fluid, and a casting apparatus in fluid communication with the molten metal. The fluid is supplied into the furnace for applying fluid pressure on the molten metal. The application of fluid pressure on the molten metal causes the molten metal to supply the casting apparatus. The outer wall structure of the furnace is provided with a plurality of exhaust ports where the ports are provided in the outer wall structure at predetermined locations. The ports are selectively controllable between a first closed position, where the exhaust ports do not allow air to be exhausted from the furnace, and a second opened position, where the exhaust ports enable air to be exhausted from the furnace.

Other advantages of this invention will become apparent to those skilled in the art from the following detailed description of the preferred embodiments, when read in light of the accompanying drawings.

DETAILED DESCRIPTION OF THE PREFERRED EMBODIMENTS

Figure 1:
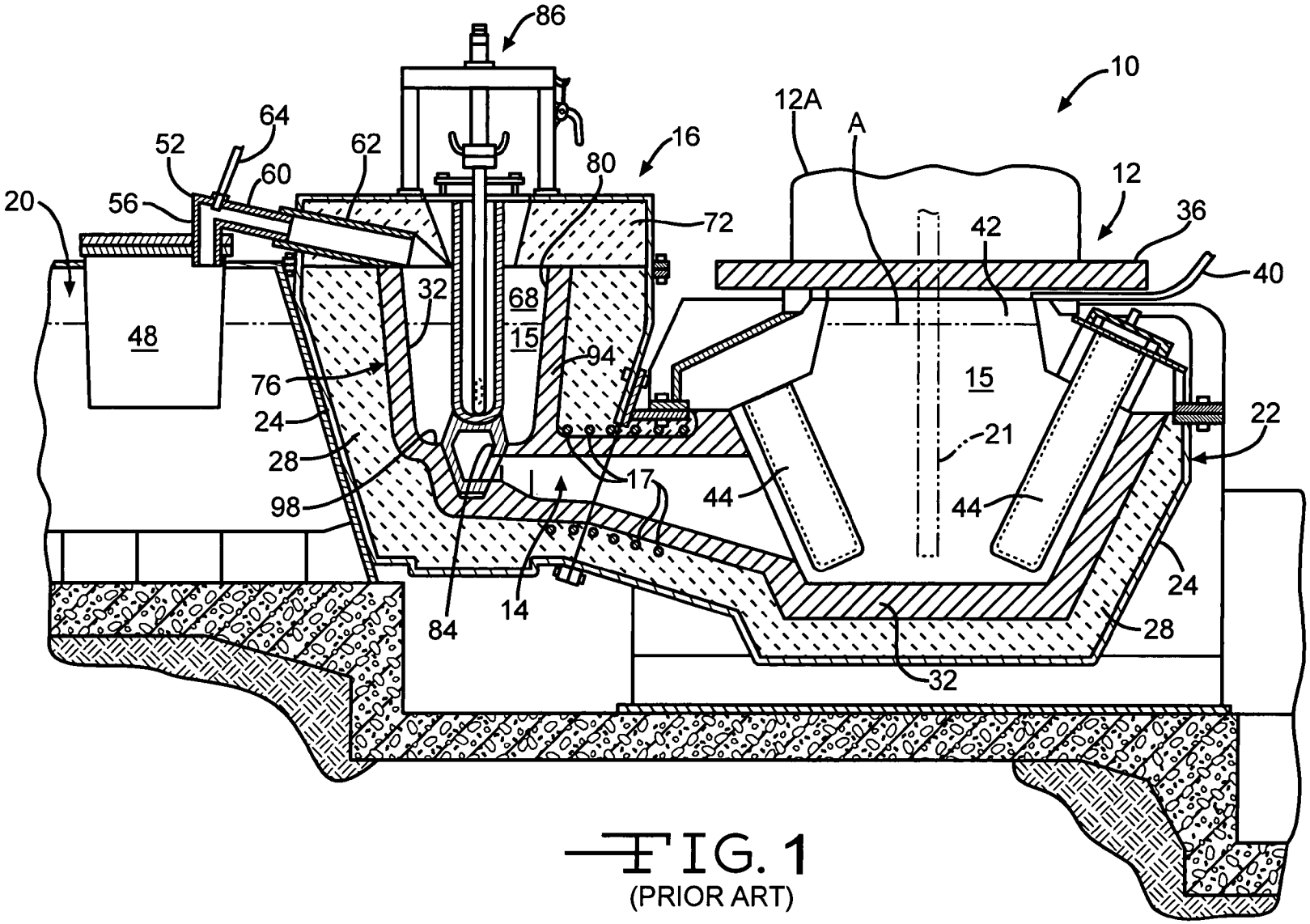
FIG. 1 (PRIOR ART)
FIG. 1 is a partial sectional elevation view of a portion of a prior art casting machine furnace apparatus.

Referring now to FIG. 1, there is illustrated a portion of a prior art casting machine furnace apparatus, indicated generally at 10. The casting machine furnace apparatus 10 is illustrated as being a low pressure countergravity casting apparatus. Although this invention will be described and illustrated in conjunction with the particular casting machine furnace apparatus 10 disclosed herein, it will be appreciated that the invention may be used in conjunction with any other suitable types of casting machine furnace apparatuses. The general structure and operation of the prior art casting machine furnace apparatus 10 is conventional in the art. Therefore, only those portions of the prior art casting machine furnace apparatus 10 that are necessary for a full understanding of this invention will be explained and illustrated in detail. As shown in FIG. 1, the illustrated prior art casting machine furnace apparatus 10 includes a casting machine furnace 12 in fluid communication with a supply furnace 16 which supplies the casting machine furnace 12 with molten metal 15 through a passageway 14. The passageway 14 may include one or more suitable heating coils 17 proximate thereto, which are operative to generally prevent the molten metal 15 from cooling excessively as it passes through the passageway 14. The molten metal 15 is supplied to the supply furnace 16 by a holding furnace 20.

The machine furnace 12 preferably supplies the molten metal 15 to a casting apparatus (partially shown at 12A) thereof through a stalk tube 21 to produce a molded part (not shown). However, the machine furnace 12 can supply the molten metal 15 to any other suitable device or location. An example of a casting apparatus 12A which can be supplied with the molten metal 15 is disclosed in U.S. Pat. No. 5,215,141 to Kuhn et al., and U.S. Pat. No. 6,627,146 to McKibben et al., the disclosures of which are incorporated herein by reference. Thus, it can be seen that in the illustrated embodiment, the molten metal 15 generally flows in a "downstream" direction from the holding furnace 20 through the supply furnace 16 to the casting machine furnace 12 and to the casting apparatus 12A.

The illustrated casting machine furnace 12 includes a furnace 22 having an outer wall 24. An intermediate insulation layer 28 covers an inner surface of the outer wall 24. The insulation layer 28 is preferably made of a material that does not transfer heat well. An inner liner 32 is positioned adjacent an inner surface of the insulation layer 28. The inner liner 32 is preferably made of a more refractory material that does transfer heat well. Typically, the outer wall 24 is made of steel, the insulation layer 28 is made of an Alumina Silica material, and the inner liner 32 is made of a silicon carbide material. Alternatively, the insulation layer 28 and/or the inner liner 32 can be made from other suitable materials.

The casting machine furnace 12 further includes a cover 36 made of a suitable type of material, preferably an insulating type of material. A typical material for the cover 36 is 4140 steel. The casting machine furnace 12 is provided with a fluid inlet 40 to allow a suitable fluid 42 to be selectively added to the casting machine furnace 12. The fluid inlet 40 can be provided in the cover 36 as shown, or can be provided in the cover 36 at any suitable location or locations. Preferably, the fluid 42 is a gas that does not interfere with the physical or chemical properties of the molten metal 15 in the casting machine furnace apparatus 10. A suitable fluid 42 that can be used is nitrogen gas or very dry air. In prior art FIG. 1, a dotted line A is provided and is used to illustrate the associated levels of the molten metal 15 and the gas 42 in the casting machine furnace 12.

The illustrated casting machine furnace 12 preferably includes one or more heating elements 44 (two of such heating elements 44 being illustrated in prior art FIG. 1). As shown in prior art FIG. 1, at least a portion of each of the heating elements 44 preferably extends into the molten metal 15 in the casting machine furnace 12. It can be appreciated that any suitable heating apparatus can be used with the casting machine furnace 12, such as a glow bar heater (not shown in FIG. 1). The glow bar heater is preferably covered with a protection tube in order to protect the heater surface from contact with the molten metal 15.

The holding furnace 20 is a suitably shaped vessel designed to hold the molten metal 15. The illustrated holding furnace 20 includes a pump 48. The pump 48 is provided to pump the molten metal 15 from the holding furnace 20 to the supply furnace 16. Any suitable pump 48 can be used for this purpose. One pump 48 that can be used is a Lindberg Varco 100 pump, manufactured by Lindberg/MPH of Riverside, Mich. The pump 48 is operative to move the molten metal 15 from the holding furnace 20 to the supply furnace 16 through a conduit 52.

The illustrated conduit 52 is a generally L-shaped pipe and includes a first generally vertical portion 56 in fluid communication with a second downwardly extending portion 60. Preferably, the conduit 52 is a ceramic lined discharge elbow and is available from Lindberg/MPH of Riverside, Mich. The downwardly extending portion 60 is operatively joined to a tube 62. Preferably, the tube 62 is a silicon carbide ceramic tube. Alternatively, the tube can be made from other suitable materials.

The conduit 52 includes a fluid inlet 64 provided therein to allow a suitable fluid 68 to be added to the conduit 52. Preferably, the fluid 68 is a gas that does not interfere with the physical or chemical properties of the molten metal 15. A suitable fluid that can be used is nitrogen gas.

The illustrated supply furnace 16 includes the outer wall 24 covered by the intermediate insulation layer 28. The insulation layer 28 is covered by and supports the inner liner 32. The tube 62 extends through the outer wall 24, the insulation layer 28, and the inner liner 32 of the supply furnace 16 to allow the molten metal 15 to be supplied from the holding furnace 20 to the supply furnace 16. In prior art FIG. 1, a dotted line B is provided and is used to illustrate the associated levels of the molten metal 15 and the gas 42 in the supply furnace 16. The illustrated supply furnace 16 further includes a cover 72 made of a suitable type of material, preferably an insulating type of material. In the preferred embodiment, the casting machine furnace 12 and the supply furnace 16 include common components, namely the outer wall 24, the insulation layer 28, and the inner liner 32. Alternatively, the construction of the casting machine furnace 12 and the supply furnace 16 can be other than illustrated if so desired.

The inner liner 32 of the supply furnace 16 is operative to define a receptacle 76. The receptacle 76 includes a first or upper opening 80 and a second or lower opening 84. The top opening 80 is defined by a side wall 94 of the receptacle 76. The bottom opening 84 is formed in an end wall 98 of the receptacle 76. The cover 72 covers the top opening 80. The supply furnace 16 includes a stopper moving device 86 that selectively allows and prevents molten metal 15 from flowing from the supply furnace 16 to the passageway 14 and the machine furnace 12. The construction and operation of the casting machine furnace apparatus 10 thus far described is conventional in the art.

Figure 2:
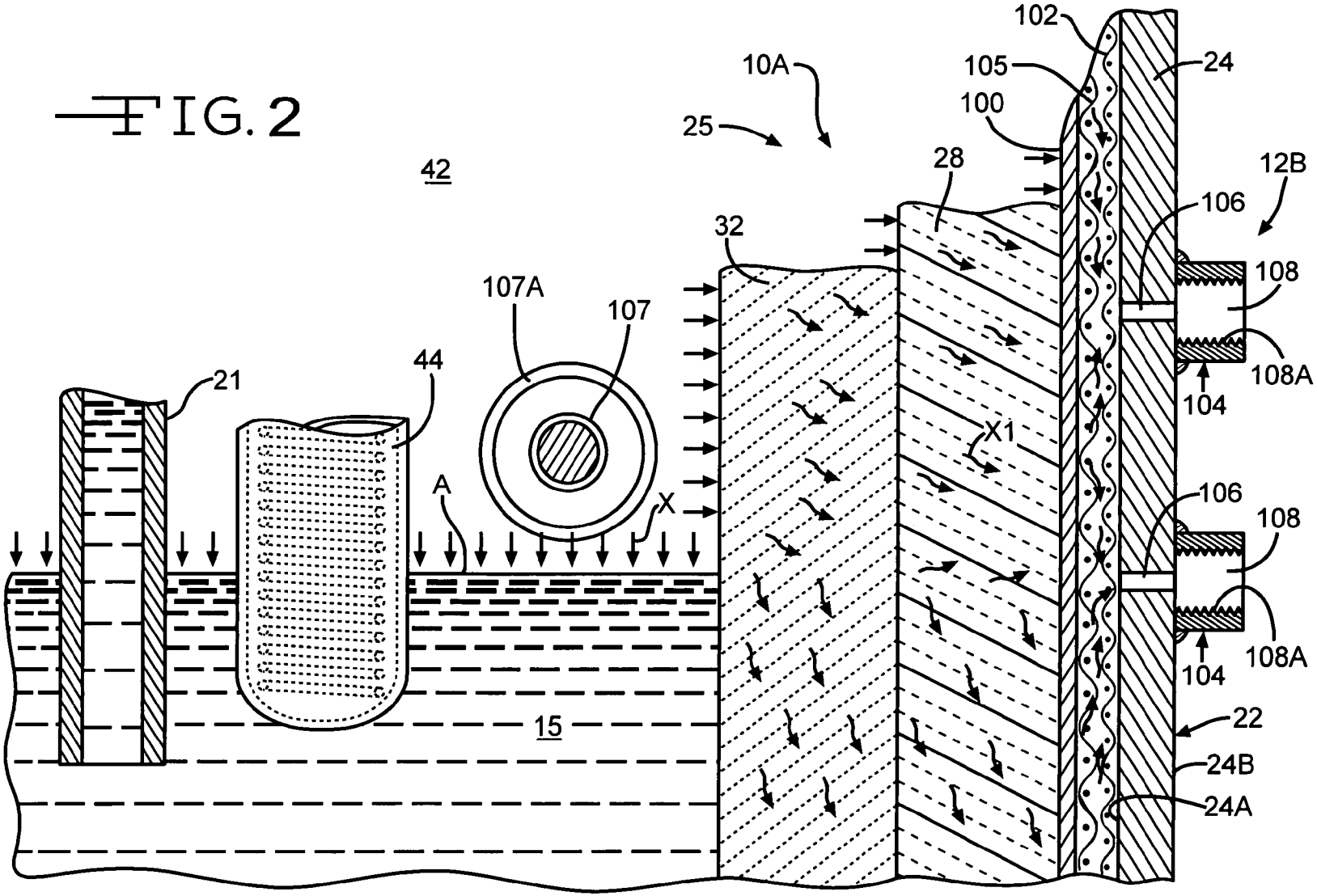
FIG. 2 is a sectional view of a portion of a first embodiment of a casting machine furnace apparatus according to the present invention, the casting machine furnace apparatus being shown during a pressurization cycle with the venting mechanism being shown in a closed position.
Figure 3:
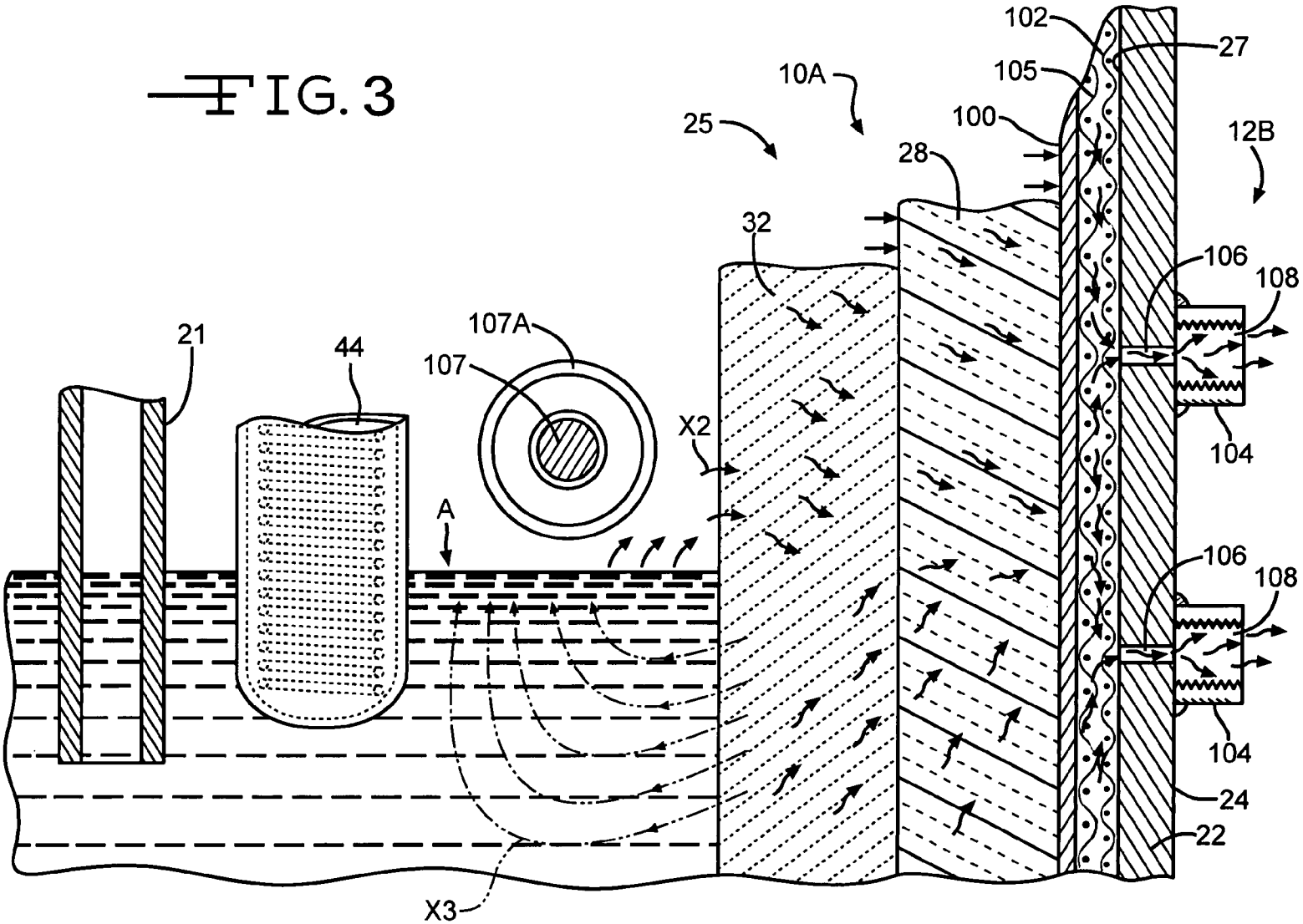
FIG. 3 is a sectional view of a portion of the first embodiment of the casting machine furnace apparatus according to the present invention, the casting machine furnace apparatus being shown during a depressurization cycle with the venting mechanism being shown in an open position.

Referring now to FIGS. 2 and 3 and using like reference numbers to indicate corresponding parts, there is illustrated a cross-sectional view of a portion of a machine furnace 12 portion of a first embodiment of a casting machine furnace apparatus 10A according to the present invention. Particularly, a portion of an outer wall structure 25 of the casting machine furnace apparatus 10A is shown, including the plurality of layers that form the outer wall structure 25 according to the present invention. In this embodiment, the inner liner 32 is preferably made from an insulating refractory material. The inner liner layer 32 is preferably a high-density refractory material that can be cast in place or can be a pre-cast element. An intermediate insulation layer 28 is provided between the inner liner layer 32 and the outer wall 24. The intermediate insulation layer 28 is also preferably made from a refractory material. However, it is preferred that the intermediate insulation layer 28 is made from a respectively lower density material than the material of the inner liner layer 32. It is also preferable that the intermediate layer 28 be cast in place. The inner liner 32, the intermediate insulation layer 28 or both can be made from other suitable materials. For example, the intermediate insulation layers can be made from ceramic or brick, if so desired. It is further preferred that both the inner liner 32 and the intermediate insulation layer 28 are somewhat permeable to the fluid 42, thereby allowing some of the fluid 42 to pass through the layers 28 and 32.

In the illustrated embodiment, the outer wall structure 25 of the present invention further includes a refractory paper layer 100 and an "opened" metal grid layer 102 positioned between the intermediate insulating layer 28 and the outer wall 24 of the furnace 22. The refractory paper layer 100 is commercially available under the Trademark "FIBERFRAX" from the Unifrax Corporation of Niagara Falls, N.Y. As with the inner liner refractory layer 32 and the insulating refractory layer 28, the refractory paper layer 100 is preferably permeable to the fluid 42 that is used to pressurize the machine furnace 12. More preferably, the refractory paper layer 100 is more highly permeable to the fluid 42 than both the inner liner refractory layer 32 and the insulating refractory layer 28. Similarly, the metal grid layer 102 will also allow the fluid 42 to pass through it due to the nature of the openness created by its woven or lattice like grid structure. The "openings" of the grid of the grid layer 102 can be any suitable size, the purpose of which will be described below. However, if the grid structure of the grid layer 102 is formed having relatively large openings, it is preferred that an intermediate or secondary grid layer 105 having smaller grid openings be positioned between the refractory paper layer 100 and the metal grid layer 102, as shown in the lower portion of the embodiment illustrated in FIGS. 2 and 3.

The relatively smaller grid openings of the intermediate grid layer 105 assist in supporting the paper layer 100 to prevent the paper layer 100 from being pressed or forced through the relatively larger openings of the metal grid layer 102. Using the refractory paper layer 100 and the metal grid layer 102 between the insulating refractory layer 28 and the outer wall 24 allows the fluid 42 to pass more easily through the inner liner refractory layer 32 and the insulating refractory layer 28 so as to be vented from the casting machine furnace apparatus 10A according to the present invention as will be discussed below. This is because the paper layer 100 and metal grid layer 102 are more permeable than the refractory layers 28 and 32. Thus, as will be discussed below, the fluid 42 will naturally move towards and through the less dense refractory paper layer 100 and the metal grid layer 102. In the preferred embodiment, the insulating refractory layer 28 and inner liner layer 32 are cast in place. Thus, as described above, the refractory paper layer 100 is used to prevent the material used to form the insulating refractory layer 28 from penetrating through the openings of the metal grid layer 102 during the casting-in-place operation. Therefore, it can be appreciated that if the insulating liner layer is bricked (or similarly formed) as opposed to being cast in place, the refractory paper layer 100 can be omitted since the brick would not typically pass through the openings of the metal grid layer 102. Thus, a chamber containing the metal grid layer 102 and possibly an air space could be formed between the outer surface of the insulating refractory layer 28 and the inner surface 24A of the outer wall 24. Alternatively, the chamber between the insulating refractory layer 28 and the inner surface 24A of the outer wall 24 could contain no metal grid layer 102. Although the formation of the chamber has been described with respect to an insulating layer that is not cast in place, it can be appreciated that a air space chamber could also be formed with an embodiment having a cast in place insulating layer. The chamber could be formed using any suitable methods.

Formed through the outer wall 24 of the outer wall structure 25 of the furnace 22 is at least one passage or opening 106 (two of such passages 106 are shown in FIGS. 2 and 3). The passage 106 preferably extends from an inner surface 24A of the outer wall 24 to an outer surface 24B of the outer wall 24 of the furnace 22. It is further preferred that an exhaust port 104 is provided on the outer surface 24B of the outer wall 24 of the furnace 22 at each respective passage 106. In the illustrated embodiment, the port 104 is formed as a separate part and is secured to the furnace 22 adjacent the passage 106 by suitable means, such as for example welding. Alternatively, the port 104 could be formed integrally with the furnace 22 if so desired. The port 104 has a bore 108 formed therethrough such that the passage 106 is in fluid communication with the bore 108 of the port 104. The purpose of the exhaust port 104 will be explained in greater detail below. In the illustrated embodiment, the bore 108 of the port 104 is provided with internal threads 108A.

It is preferred that a plurality of such ports 104 are formed on the outer wall 24 of the furnace 22, the number of the ports 104 corresponding to the number of the passages 106. It is further preferred that the plurality of the passages 106 and the ports 104 are spaced about the perimeter of the furnace 22 in both predetermined lateral and vertical positions on the outer surface 24B of the outer wall 24 of the furnace 22 and/or on the cover of the furnace 12B. Preferably, the passages 106 and the ports 104 are spaced on the selected components of the furnace 12B in predetermined lateral and vertical positions in both the molten metal area defined below line A and the gas area defined above line A. Each port 104 is also preferably connected via airtight plumbing to a valve or valves, as will be discussed below in connection with FIG. 4. The valves can be operated to control the amount of pressure within the furnace 12B during the casting cycle as well as between cycles, as will be described in greater detail below. In the illustrated embodiment, the furnace 12B further includes one or more glow bar heaters 107 (only one of such heaters 107 shown in FIGS. 2 and 3). The glow bar heater 107 is preferably covered with a protection tube 107A in order to protect the heater surface from contact with the molten metal 15. Alternatively, the structure of the furnace 12B and/or the structure of the outer wall structure 25 of the furnace 12B can be other than illustrated if so desired.

Referring now to FIGS. 2 and 3 and also prior art FIG. 1 for those components not illustrated in FIGS. 2 and 3, the operation of the first embodiment of the casting machine furnace apparatus 10A according to the present invention will be described. In the illustrated embodiment, molten metal 15 is supplied to the casting machine furnace 12B from the supply furnace 16. It can be appreciated that although a particular delivery method has been described herein, any suitable method of delivering molten metal into the furnace 12B can be used. The supply line is preferably insulated to prevent heat loss from the molten metal 15 being supplied by the supply furnace 16 to the casting machine furnace 12B. The molten metal 15 is preferably maintained at a generally consistent level in the furnace 12B, as indicated by the dotted line A. There is preferably an enclosed fluid space 42 between the molten metal 15 and the cover 36. The fluid inlet 40 communicates with the casting machine furnace 12 to supply the fluid 42 to the casting machine furnace 12. The machine furnace 12 preferably supplies the molten metal 15 to a casting apparatus (partially shown at 12A in FIG. 1) thereof through a stalk tube 21 to produce a molded part (not shown). However, the machine furnace 12 can supply the molten metal 15 to any other suitable casting device or location.

The molten metal 15 is supplied to the casting apparatus 12A as described herein to produce a cast article (not shown) in the casting apparatus cavity. The cast article is preferably a vehicle component. However, it can be appreciated that the cast article can be any desired article that can be formed using this casting method, such as a vehicle wheel, household goods, vehicle workpieces and the like. It should be understood that the cast article is preferably about the same shape and about the same contour as the casting apparatus cavity. Also, it can be appreciated that it is preferred that the casting apparatus cavity is preferably an airtight cavity, and that the molten metal 15 that enters the casting apparatus 12A is contained within the casting apparatus cavity. However, the casting apparatus cavity is not required to be airtight.

To supply the molten metal 15 from the casting machine furnace 12B into the casting apparatus 12A, a controlled amount of the fluid 42 is supplied through the fluid inlet 40, which in turn causes the molten metal 15 to move upwardly through the stalk tube 21, and into the casting apparatus 12A. The fluid 42 is preferably supplied under pressure, thereby causing the pressure within the furnace 12 to achieve a first pressurization level, P1. It should be understood that by selectively controlling the amount of pressure in the furnace 12, the rate at which molten metal 15 is supplied to the casting apparatus 12A is selectively controlled. This pressurization sequence is generally conventional in the art and the first pressurization level, P1 is generally maintained until the desired amount of molten metal 15 is received within the casting apparatus 12A. Additionally, in this embodiment of the invention, to maintain the first pressurization level, P1, the valve or valves connected to the ports 104 are preferably closed during this portion of the casting cycle.

Once the desired amount of molten metal 15 is received within the casting apparatus 12A, the pressure above the melt (i.e., above the dotted line A) is preferably maintained until the casting(s) is solidified. During the period in which the first pressurization, P1 is maintained, it is possible that the fluid 42 can permeate the porous lining layers 28 and 32 of the machine casting furnace 12B (for discussion purposes, such fluid 42 which permeates the layers 28 and 32 is indicated by the "crooked" arrows X1 shown in FIG. 2, and the fluid 42 acting upon the metal 15 is shown by straight arrows X). Upon completion of the casting cycle the casting machine furnace 12B is typically depressurized so that the casting machine furnace 12B can be replenished with additional molten metal 15 prior to the commencement of another casting cycle. Using conventional methods, upon the release of the fluid pressure above the molten metal, the fluid trapped in the porous lining layers 28 and 32 of the furnace can escape into the molten metal 15, pass through the melt, and then rise to the surface of the melt. When this process occurs, it can leave contaminants in the molten metal 15 as well as on other components of the furnace, such as the inner surface of the inner liner 32, on the stalk tube 21 and on the immersion heater 44 protection tubes. However, in the preferred embodiment according to the present invention, the depressurization is controlled by the valves, described above, to control and reduce the amount of fluid 42 that reenters the molten metal 15 to prevent or reduce the contaminants from occurring in the molten metal 15 as well as on the other components of the furnace.

As illustrated in FIG. 2, the arrows X1 indicate the permeation of the fluid 42 into the porous refractory layers, (inner liner 32 and insulation layer 28) of the outer wall structure 25 of the furnace 12B, as well as the refractory paper layer 102 and metal grid layer 104 of the outer wall structure of the furnace 12B. Due to the valves being closed during the first pressurization stage of the casting cycle, there is no path that would allow the fluid 42 to pass out of the layers that form the outer wall structure 25. Thus, the fluid that has permeated those layers will remain in such layers until the furnace 12B is depressurized. As discussed above, due to the refractory paper layer 100 and the metal grid layer 102 (and metal grid layer 105 if used), being more permeable than the inner liner refractory layer 32 and the insulating refractory layer 28, there will be a tendency for the permeated fluid 42 to migrate towards the refractory paper layer 100 and the metal grid layer 102. This will, in effect, saturate those layers with the fluid 42. While the pressure P1 is maintained, the fluid 42 remains in the outer wall structure 25.

Referring now to FIG. 3, there is illustrated the casting machine furnace 12 according to the first embodiment of the present invention during an initial depressurization stage. During the initial depressurization stage, one or more of the valves connected to the plurality of ports 104 on the furnace 22 are selectively opened to reduce the pressure (first pressurization level P1) within the furnace 12B. Selectively opening the valves causes a controlled release of the pressure of the fluid 42 that has accumulated in the refractory paper layer 100 and the metal grid layer 102, as well as the pressure of the fluid 42 that has accumulated in the liner refractory layer 32 and the insulating refractory layer 28. The laws of physics dictate that fluid has a tendency to move from an area of relatively higher pressure to one of a relatively lower pressure. Thus, when the valves are opened, the fluid 42 within the outer wall structure 25 will flow through the passage 106 and the port 104, the plumbing lines connected to the port 104, and be externally vented or exhausted to the atmosphere. Using this process of the present invention, a substantial portion if not the entire amount of the fluid 42 that is contained within the outer wall structure 25 will be vented from the furnace 12B rather than being reintroduced into the molten metal 15 (as indicated by the phantom arrows X3). It can be appreciated that the fluid 42 can be exhausted to a storage structure rather than being released to the atmosphere if so desired. The flow of the fluid 42 vented from the furnace 12B according to the present invention is illustrated for discussion purposes in FIG. 3 by the crooked arrows X2.

Figure 4:
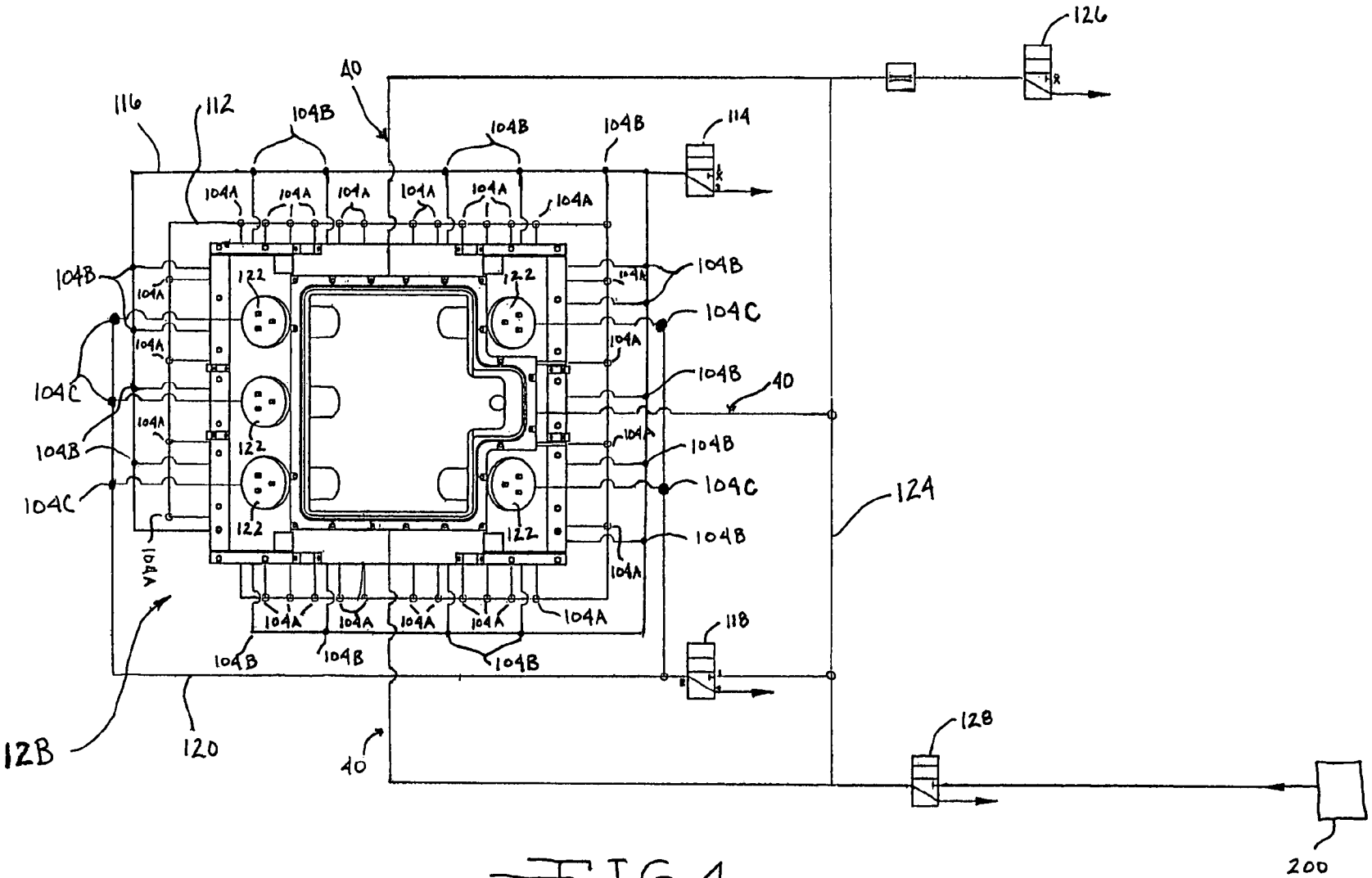
FIG. 4 is a schematic view of an exhaust system of the casting machine furnace according to the present invention.

Illustrated in FIG. 4 is a schematic diagram of a portion of the casting apparatus 10A according to the present invention. Particularly, only the furnace portion 12B is illustrated. Also schematically illustrated in FIG. 4 is a plurality of exhaust lines 112, 116, 120 extending, respectively, from the plurality of ports 104A, 104B, and 104C provided on the exterior of the furnace 12B. As described above, the ports 104A, 104B, and 104C are in fluid communication with the interior of the furnace 12B via the passages 106. Also as stated above, the ports 104A, 104B, and 104C can be formed at selected positions around the exterior of the furnace 12B at selected vertically and horizontally spaced apart locations on each side of the furnace 12B.

As is known in the art, a pressure supply member 200 is connected with at least one fluid inlet port 40 at or near the cover 36 or some other portion of the furnace 12B to supply the pressurized fluid 42 to the furnace 12B. In the embodiment illustrated in FIG. 4, three of such ports 40 are shown. As is also known, the ports 40 can also act as fluid outlets to vent the fluid 42 from the cover 36. Each of the ports 40 are connected via a set of exhaust lines 124 to a controlled depressurization exhaust member 126. In the illustrated embodiment, each of the three ports 40 are also connected via the exhaust lines 124 to an emergency dump member 128. As described above, using the furnace 12B described with respect to FIG. 1, the pressure supply member 200 will control the supply of fluid 42 into the furnace 42. Under pressurization, the furnace will supply the casting apparatus 12A with molten metal. Upon depressurization, with conventional furnace apparatuses, the controlled depressurization exhaust member 126 would allow the fluid to be released to atmosphere. Since the ports 40 are only formed on the cover with conventional furnace apparatuses, the only exit path for the fluid 42 that has permeated the refractory layers 25 will be through the melt, thereby causing contamination thereof, and out the ports 40.

In the preferred embodiment, in addition to the prior art ports 40, each side of the furnace 12B has multiple ports formed thereon in the illustrated embodiment. It is preferred that a first set of ports 104A is formed at or near a lower or bottom portion of the furnace 12B. It is further preferred that a second set of ports 104B is formed at or near an upper or top portion of the side of the furnace 12B. It is further preferred that a third set of ports 104C is operatively connected to each of the fiber cones 122 of the furnace 12B. However, it can be appreciated that the ports 104A and 104B can be formed at any position on the sides of the furnace 12B. It can also be appreciated that any suitable number of ports 104A and 104B can be positioned on each side. In the illustrated embodiment, the furnace 12B includes a total of 32 first or lower ports 104A, a total of 18 second or upper ports 104B, and a total of 5 third or cone ports 104C. Each of the first ports 104A is preferably connected to an exhaust member 114 via a first set of exhaust lines 112. The exhaust lines 112, intersecting with a second set of exhaust lines 116, are used to transport the vented fluid 42 from the furnace 12B to the atmosphere. The second set of exhaust lines 116 are preferably connected to the second ports 104B that are formed at an upper portion of the furnace 12B. The second set of exhaust lines 116 is also used to transport the vented fluid 42 from the furnace 12B and to the atmosphere. A third set of exhaust lines 120 are preferably connected to the third ports 104C that are formed at the cones 122 of the furnace 12B. The third set of exhaust lines 120 is also used to transport the vented fluid 42 from the furnace 12B and to the atmosphere via an exhaust port 118. Alternatively, the structure of the ports 104A, 104B and 104C and/or the exhaust lines 112, 116, 120 and 124 can be other than illustrated if so desired.

According to the present invention, the timing of the opening of the valves to release the fluid 42 under pressure in the outer wall structure 25A of the furnace 12 is selectively and controllably adjustable in anticipation of the release of the fluid pressure above the molten metal 15, as well as the decay time of the fluid 42 under pressure in the outer wall structure 25A of the furnace. Thus, the initial depressurization stage will commence to release the fluid pressure from the outer wall structure 25A. The desired amount of fluid 42 to be released can be controlled as a factor of time, or of pressure within the furnace 12B, or of the pressure of the fluid 42 within the outer wall structure 25A (which includes the inner liner layer 32, insulating layer 28, refractory paper layer 100 and metal grid layer 102). During the initial depressurization stage, the fluid 42 will travel through the first set of exhaust lines 112 to the exhaust member 114. Once the desired amount of venting of the fluid 42 that has permeated the outer wall structure layers 25A is achieved, (or a given decay time of the fluid 42 is met), a secondary depressurization stage can commence.

The secondary depressurization stage preferably includes the same or additional valves connected to the second ports 104B on the outer wall 24 of the furnace 22 being opened, valves (not shown) formed on or near the cover 36 being opened, or any other suitable depressurization strategy. During the secondary depressurization stage, in the preferred embodiment, the fluid 42 will travel through the second set of exhaust lines 116 to the exhaust member 114. An example of another depressurization strategy includes, after the initial depressurization stage, ports 104B on an upper portion of the furnace 12B being vented, followed by ports 104C on the cover 36 being vented. The ports 104C can be provided in associated fiber cones 120 of the furnace 12B. The ports 104C are preferably connected via a third set of exhaust lines 124 to the controlled depressurization exhaust member 126 and the emergency dump exhaust member 128. Once the initial depressurization stage and any subsequent depressurization stages have been completed, the cover 36 could be removed. Removal of the cover 36 only after some of the fluid 42 has been vented from the furnace 12 will minimize or eliminate the amount of fluid 42 that effervesces into the molten metal 15. This in turn will reduce the contamination effect the fluid 42 has on the molten metal 15 contained in the furnace 12B.

Pressure casting furnaces typically have one large servo valve and one large control valve thorough which the fluids used to pressurize the furnace 12 flow. When the casting cycle is complete, the servo valve 200 goes to zero pressure and the large control valve 126 goes to exhaust. During an emergency, it may be necessary to rapidly exhaust the furnace. The casting apparatus 12A according to the present invention includes, but does not require, a second control valve 114 much smaller in size. The pressurization cycle will be similar to the prior art pressurization cycles, except during depressurization. During depressurization, the servo valve 200 will go to zero and the fluid will be exhausted though the small control valve 126 with an adjustable exhaust orifice. By using the smaller valve 114 with an adjustable orifice for exhausting at a controlled rate, the pressure decline above the melt will be better matched to the declining pressure in the outer wall structure 25. In this embodiment, during an emergency, both valves can go to exhaust.

Figure 5:
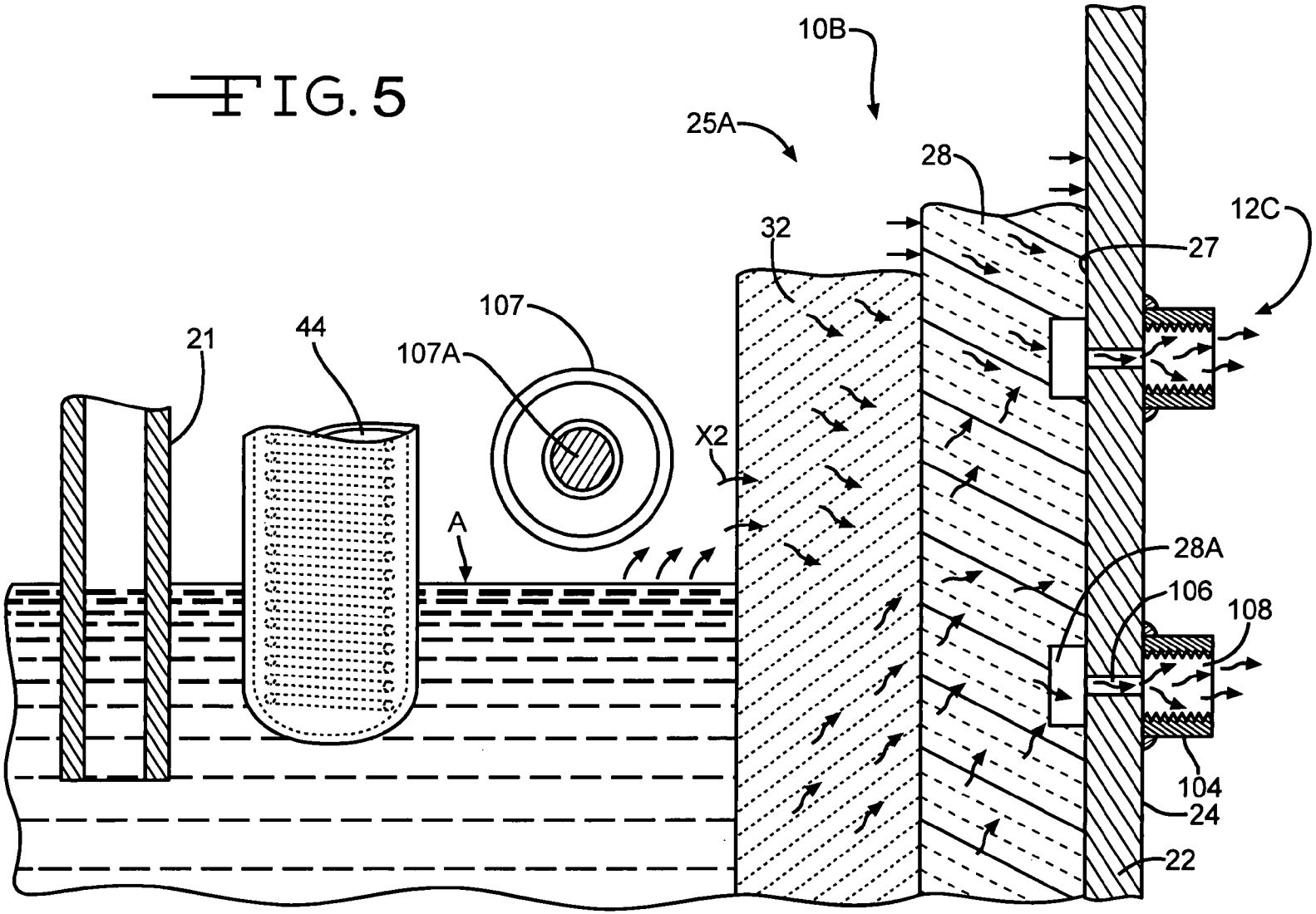
FIG. 5 is a sectional view of a portion of a second embodiment of a casting machine furnace apparatus according to the present invention, the casting machine furnace apparatus being shown during a depressurization cycle with the venting mechanism being shown in an open position.

Turning now to FIG. 5 and using like reference numbers to indicate corresponding parts, there is illustrated a portion of a second embodiment of a casting machine furnace apparatus 10B having a machine furnace 12C according to the present invention. In this embodiment, the furnace 12C includes an outer wall structure 25A having an inner liner 32, an outer wall 24, and an intermediate insulation layer 28. As shown therein, the insulation layer 28 is provided with a plurality of pockets or openings 28A formed therein (only two of such pockets 28A being shown). Thus, in this embodiment, the outer wall structure 25B does not include the layers 100 and 102/105 of the first embodiment shown in FIGS. 2 and 3. In operation, the pockets 28A function similar to the layers 100 and 102/105 in FIGS. 2 and 3 and permit the fluid 42 to vent through the associated passages 106 and ports 104A and 104B.

One advantage of the present invention is that the furnace includes an outer wall structure that is effective to provide an easier path for the fluid to escape or vent from the furnace to reduce or prevent contamination of the melt. Also, the present invention reduces oxide build-up on the immersion heaters and/or glow bar heaters thereby simplifying cleaning and extending the life span and efficiency of the heaters. Also, the present invention reduces oxide build-up on the inside surfaces of the furnace, i.e., inner liner, thereby simplifying cleaning and extending the life span of the furnace lining. In addition, the present invention reduces the contamination of the melt and oxide formation on both the heaters and the furnace lining from the residual moisture contained in the lining.

The principle and mode of operation of this invention have been described in its preferred embodiments. However, it should be noted that this invention may be practiced otherwise than as specifically illustrated and described without departing from its scope.

What is claimed is:

1. A casting machine furnace apparatus comprising:

a furnace adapted to receive molten metal, said furnace including an outer wall structure;

a cover adapted to seal the furnace;

a source of fluid, said fluid being supplied into said furnace for applying fluid pressure on said molten metal; and a casting apparatus in fluid communication with said molten metal such that application of said fluid pressure on said molten metal causes said molten metal to supply said casting apparatus;

wherein said outer wall structure of said furnace is provided with a plurality of exhaust ports said exhaust ports being provided in said outer wall structure at predetermined locations and selectively controllable between a first closed position, wherein said exhaust ports do not allow air to be exhausted from said furnace, and a second opened position, wherein said exhaust ports enable air to be exhausted from said furnace; and wherein said outer wall structure of said furnace is provided with a plurality of air pockets, wherein a respective one of said plurality of air pockets is located directly adjacent a respective one of said exhaust ports so as to provide a fluid path from an interior chamber of said furnace, to said plurality of air pockets, and to said plurality of exhaust ports.

2. The casting machine furnace apparatus according to claim 1 wherein said outer wall structure of said furnace includes at least an outer wall and an inner insulating layer, said outer wall having an inner wall surface, and wherein said plurality of pockets are formed in said insulating layer directly adjacent said inner wall surface of said outer wall.

3. The casting machine furnace apparatus according to claim 1 wherein said outer wall structure includes at least an outer wall, an inner insulating layer, and an intermediate fluid chamber layer disposed between said outer wall and said inner insulating layer, said intermediate fluid chamber layer including at least a paper layer.

4. The casting machine furnace apparatus according to claim 3 wherein said intermediate fluid chamber layer further includes a metal grid layer interposed between said paper layer and said outer wall.

5. The casting machine furnace apparatus according to claim 3 wherein said intermediate fluid chamber layer is more permeable than said inner insulating layer.

6. The casting machine furnace apparatus according to claim 1 wherein said outer wall structure of said furnace includes an outer wall having an inner wall surface, a fluid chamber layer disposed adjacent said inner wall surface of said outer wall, an insulating layer disposed adjacent said fluid chamber layer, and an inner liner layer disposed adjacent said insulating layer, said intermediate fluid chamber layer including at least a paper layer.

7. The casting machine furnace apparatus according to claim 6 wherein said fluid chamber layer further includes a metal grid layer interposed between said inner wall surface of said outer wall and said paper layer.

8. The casting machine furnace apparatus according to claim 6 wherein said fluid chamber layer is more permeable than said insulating layer and said insulating layer is more permeable than said inner liner layer.

9. A casting machine furnace apparatus comprising:

a furnace adapted to receive molten metal, said furnace including an outer wall structure, said outer wall structure provided with a plurality of exhaust ports, said exhaust ports being provided in said outer wall structure at predetermined locations and selectively controllable between a first closed position, wherein said exhaust ports do not allow air to be exhausted from said furnace, and a second opened position, wherein said exhaust ports enable air to be exhausted from said furnace;

wherein said outer wall structure of said furnace is provided with a fluid chamber layer, wherein said fluid chamber layer is located directly adjacent said exhaust ports so as to provide a fluid path from an interior chamber of said furnace, to said fluid chamber layer, and to said plurality of exhaust ports.

10. The casting machine furnace apparatus according to claim 9 wherein said outer wall structure of said furnace includes at least an outer wall and an inner insulating layer, said outer wall having an inner wall surface, and wherein said fluid chamber layer is formed in said insulating layer directly adjacent said inner wall surface of said outer wall.

11. The casting machine furnace apparatus according to claim 9 wherein said outer wall structure includes at least an outer wall and an inner insulating layer, and wherein said fluid chamber layer is disposed between said outer wall and said inner insulating layer, said fluid chamber layer including at least a paper layer.

12. The casting machine furnace apparatus according to claim 11 wherein said fluid chamber layer further includes a metal grid layer interposed between said paper layer and said outer wall.

13. The casting machine furnace apparatus according to claim 11 wherein said fluid chamber layer is more permeable than said inner insulating layer.

14. The casting machine furnace apparatus according to claim 11 wherein said fluid chamber layer is more permeable than said insulating layer and said insulating layer is more permeable than said inner liner layer.

15. The casting machine furnace apparatus according to claim 9 wherein said fluid chamber layer is comprised of at least a first material and a second different material.

16. A casting machine furnace apparatus comprising:

a furnace having an outer wall structure provided with a plurality of exhaust ports, said exhaust ports being selectively controllable between a first closed position, wherein said exhaust ports do not allow air to be exhausted from said furnace, and a second opened position, wherein said exhaust ports enable air to be exhausted from said furnace;

wherein said outer wall structure of said furnace is provided with a fluid chamber layer located directly adjacent said exhaust ports so as to provide a fluid path from an interior chamber of said furnace, to said fluid chamber layer, and to said plurality of exhaust ports.

17. The casting machine furnace apparatus according to claim 16 wherein said outer wall structure of said furnace includes at least an outer wall and an inner insulating layer, said outer wall having an inner wall surface, and wherein said fluid chamber layer is formed in said insulating layer directly adjacent said inner wall surface of said outer wall.

18. The casting machine furnace apparatus according to claim 16 wherein said outer wall structure includes at least an outer wall and an inner insulating layer, and wherein said fluid chamber layer is disposed between said outer wall and said inner insulating layer, said fluid chamber layer including at least a paper layer.

19. The casting machine furnace apparatus according to claim 18 wherein said fluid chamber layer further includes a metal grid layer interposed between said paper layer and said outer wall.

20. The casting machine furnace apparatus according to claim 18 wherein said fluid chamber layer is more permeable than said inner insulating layer.

21. The casting machine furnace apparatus according to claim 18 wherein said fluid chamber layer is more permeable than said insulating layer and said insulating layer is more permeable than said inner liner layer.

22. The casting machine furnace apparatus according to claim 16 wherein said fluid chamber layer is comprised of at least a first material and a second different material.

* * * * *